US006090253A

United States Patent [19]

Shima et al.

[11] Patent Number: 6,090,253

[45] Date of Patent: Jul. 18, 2000

[54] ELECTRODEPOSITION METHOD

[75] Inventors: Kenshichiro Shima; Takashi Arakawa; Hirokazu Sugiyama, all of Kanagawa-ken, Japan

[73] Assignee: Nissan Motor Co., Ltd., Kanagawa-ken, Japan

[21] Appl. No.: 09/144,642

[22] Filed: Aug. 31, 1998

[30] Foreign Application Priority Data

Sep. 8, 1997 [JP] Japan ..... 9-259345

[51] Int. Cl.[7] ..... C25D 13/06

[52] U.S. Cl. ..... 204/507; 204/509; 204/500

[58] Field of Search ..... 204/507, 500, 204/509

[56] References Cited

U.S. PATENT DOCUMENTS 4,436,594 3/1984 Nishida et al. ..... 204/510

FOREIGN PATENT DOCUMENTS 47-22435 10/1972 Japan .
6-228794 8/1994 Japan .
6-235094 8/1994 Japan .
7-185439 7/1998 Japan .

*Primary Examiner*—Kishor Mayekar
*Attorney, Agent, or Firm*—McDermott, Will & Emery

[57] ABSTRACT

A work is dipped in electrodeposition paint, and then the work is baked. Between the dipping step and baking step of the work, there is provided a step for spraying hot water mist to the work. It is preferable that the temperature of the hot water mist is in a range equal to or higher than 40° C. and lower than 100° C. Water or vapor may be used instead of the hot water mist.

14 Claims, 17 Drawing Sheets

EXAMPLE 3

FIG.17

| | RATIO OF SAG TRACK AREA (NOTE 1) | CONDITION OF SURFACE OF SAG TRACK (NOTE 2) |
|---|---|---|
| EXAMPLE 1 | 75 | DEGREE OF ROUGH SURFACE: MEDIUM |
| EXAMPLE 2 | 70 | DEGREE OF ROUGH SURFACE: MEDIUM |
| EXAMPLE 3 | 40 | DEGREE OF ROUGH SURFACE: SMALL |
| EXAMPLE 4 | 60 | DEGREE OF ROUGH SURFACE: MEDIUM |
| EXAMPLE 5 | 35 | DEGREE OF ROUGH SURFACE: SMALL |
| COMPARATIVE EXAMPLE 1 | 100 | DEGREE OF ROUGH SURFACE: MEDIUM |
| COMPARATIVE EXAMPLE 2 | 75 | DEGREE OF ROUGH SURFACE: GREAT |
| COMPARATIVE EXAMPLE 3 | 45 | DEGREE OF ROUGH SURFACE: GREAT |

(NOTE 1) : THE RATIO OF SAG TRACK AREA IS A RATIO WHEN THE COMPARATIVE EXAMPLE IS TAKEN AS 100

(NOTE 2) : CONDITION OF ROUGH SURFACE ○=DEGREE OF ROUGH SURFACE IS SMALL;
CONDITION OF ROUGH SURFACE △=DEGREE OF ROUGH SURFACE IS MEDIUM; AND
CONDITION OF ROUGH SURFACE ×=DEGREE OF ROUGH SURFACE IS GREAT

FIG.18

| | RATIO OF SAG TRACK AREA (NOTE 1) | CONDITION OF SURFACE OF SAG TRACK (NOTE 2) | PRESENCE OR ABSENCE OF LONG SAG TRACK |
|---|---|---|---|
| EXAMPLE 6 | 80 | DEGREE OF ROUGH SURFACE: MEDIUM | NO LONG SAG TRACK IN ALL AUTOMOBILES |
| EXAMPLE 7 | 75 | DEGREE OF ROUGH SURFACE: MEDIUM | NO LONG SAG TRACK IN ALL AUTOMOBILES |
| EXAMPLE 8 | 45 | DEGREE OF ROUGH SURFACE: SMALL | NO LONG SAG TRACK IN ALL AUTOMOBILES |
| EXAMPLE 9 | 65 | DEGREE OF ROUGH SURFACE: MEDIUM | NO LONG SAG TRACK IN ALL AUTOMOBILES |
| EXAMPLE 10 | 40 | DEGREE OF ROUGH SURFACE: SMALL | NO LONG SAG TRACK IN ALL AUTOMOBILES |
| COMPARATIVE EXAMPLE 4 | 100 | DEGREE OF ROUGH SURFACE: MEDIUM | LONG SAG TRACK EXISTS IN THREE OUT OF FIVE AUTOMOBILES |
| COMPARATIVE EXAMPLE 5 | 95 | DEGREE OF ROUGH SURFACE: MEDIUM | LONG SAG TRACK EXISTS IN THREE OUT OF FIVE AUTOMOBILES |
| COMPARATIVE EXAMPLE 6 | 75 | DEGREE OF ROUGH SURFACE: GREAT | NO LONG SAG TRACK IN ALL AUTOMOBILES |
| COMPARATIVE EXAMPLE 7 | 45 | DEGREE OF ROUGH SURFACE: GREAT | NO LONG SAG TRACK IN ALL AUTOMOBILES |

(NOTE 1) : THE RATIO OF SAG TRACK AREA IS A RATIO WHEN THE COMPARATIVE EXAMPLE IS TAKEN AS 100

(NOTE 2) : CONDITION OF ROUGH SURFACE ○=DEGREE OF ROUGH SURFACE IS SMALL;
CONDITION OF ROUGH SURFACE △=DEGREE OF ROUGH SURFACE IS MEDIUM; AND
CONDITION OF ROUGH SURFACE ×=DEGREE OF ROUGH SURFACE IS GREAT

FIG.19

| | RATIO OF SAG TRACK AREA (NOTE 1) | CONDITION OF SURFACE OF SAG TRACK (NOTE 2) |
|---|---|---|
| EXAMPLE 11 | 70 | △ |
| EXAMPLE 12 | 65 | △ |
| EXAMPLE 13 | 50 | ○ |
| EXAMPLE 14 | 20 | ○ |
| EXAMPLE 15 | 60 | △ |
| EXAMPLE 16 | 50 | ○ |
| EXAMPLE 17 | 30 | ○ |
| EXAMPLE 18 | 25 | ○ |
| EXAMPLE 19 | 50 | △ |
| EXAMPLE 20 | 30 | ○ |
| EXAMPLE 21 | 25 | ○ |
| EXAMPLE 22 | 15 | ○ |
| EXAMPLE 23 | 50 | △ |
| EXAMPLE 24 | 25 | ○ |
| EXAMPLE 25 | 20 | ○ |
| EXAMPLE 26 | 15 | ○ |
| COMPARATIVE EXAMPLE 8 | 95 | △ |
| COMPARATIVE EXAMPLE 9 | 80 | × |

(NOTE 1) : THE RATIO OF SAG TRACK AREA IS A RATIO WHEN THE COMPARATIVE EXAMPLE IS TAKEN AS 100

(NOTE 2) : CONDITION OF ROUGH SURFACE ○=DEGREE OF ROUGH SURFACE IS SMALL;
CONDITION OF ROUGH SURFACE △=DEGREE OF ROUGH SURFACE IS MEDIUM; AND
CONDITION OF ROUGH SURFACE ×=DEGREE OF ROUGH SURFACE IS GREAT

ELECTRODEPOSITION METHOD

BACKGROUND OF THE INVENTION

1. Field of the Invention

The present invention relates to an electrodeposition method for an automobile and the like, and more particularly, to an electrodeposition method which prevents an electro sag which ejects from a joint of steel plates.

2. Description of the Related Art

An automobile body (so-called white body) which has been subjected to a welding step is subjected to an electrodeposition as a primer coating for securing an anticorrosive property. In recent electrodeposition, the body is dipped into cation electrodeposition paint for bringing the body into cathode and bringing electrode in a dipping tank (electrodeposition paint) into anode, so that an electrocoating is deposited on a surface of steel plate of the body by electro phoresis.

If the automobile body is subjected to the electrodeposition by a so-called dipping process in which the body is entirely dipped into the electrodeposition paint, it is possible to form a coating on an inner plate, a bag-like structured portion and a joint of steel plates on which a spray coating can not apply. Therefore, the dipping process is widely carried out as effective means for securing the anticorrosive property.

In the dipping electrodeposition method of this type, since the electrodeposition paint is remained on inner and outer surfaces of the automobile body immediately after the automobile body is pulled out from the dipping tank, there are provided setting zone and washing zone after the dipping tank, so that the remained electrodeposition paint is washed out by taking a long setting time or spraying clean water.

As a method for removing the remained electrodeposition paint, there are a conventionally know method in which a plurality of air nozzles are provided in a preheating zone before baking and drying steps so that high pressure air is sprayed to the automobile body to blow away the clean water attached to the body (see Japanese Patent Application Laid-open No. 6-228,794 for example), and a conventionally known method in which washed automobile body is inclined together with a hanger in such a manner that a rear portion of the body is higher so that washing water is discharged, and in the preheating zone before baking furnace, the body is inclined such a manner that a front portion thereof is higher so that the amount of residual washing water is reduced at the entrance of the baking furnace (see Japanese Patent Application Laid-open No. 6-235,094 for example).

However, in the above-described conventional methods, although it is effective to remove the electrodeposition paint attached on the surface of inner and outer plates or the electrodeposition paint remained in the bag-like structure or on a flower, the electrodeposition paint entered into between the joint surfaces of the steel plates can not be removed.

For example, as shown in FIG. 1A, a joint portion B between a side sill 50 and a center pillar 60 has a structure in which a center pillar outer panel 61 is fitted over a side sill outer panel 51 as shown in FIGS. 1B and 2, and the electrodeposition paint entered a clearance of the fitted surface D by capillary action ejects in the baking furnace, and such electrodeposition paint flows into the sill outer and hardened. (Refer to FIGS. 3 and 4) If such an "electro sag" which is a kind of rough surface is generated, there is a problem that a quality of finished product is deteriorated, and a lot of time is required for correcting operation.

SUMMARY OF THE INVENTION

Therefore, it is an object of the present invention to provide an electrodeposition method capable of removing electrodeposition paint entered the joint of steel plates.

To achieve the above object, according to the present invention, there is provided an electrodeposition method, comprising the steps of:

dipping a work into electrodeposition paint;

splaying mist of hot water having a temperature equal to or higher than 40° C. and lower than 100° C. to the work;

and baking the work.

According to this method, the electrodeposition paint entered the joint surfaces of the steel plates is heated by the sprayed hot water mist and the viscosity is lowered, so that the electrodeposition paint flows out. Further, by spraying the hot water mist to the work, water droplet is adhered on the surface of the work, and this water droplet has a function to pull out the flowed out electrodeposition paint so that the flowing out of the coating for deposition is facilitated.

Further, between the step of splaying mist of hot water and the step of baking, a step of heating the work at a temperature equal to or higher than 40° C. and lower than 100° C. may be provided.

In this step, the flowed out residual for electrodeposition paint is heated at a temperature equal to or higher than 40° C. and lower than 100° C. by spraying the hot water mist, thereby drying and removing the flowed out electrodeposition paint. If the temperature is less than 40° C., the drying effect is insufficient, and if the temperature is equal to or higher than 100° C., the flowed out electrodeposition paint is boiled to generate a rough surface and therefore, it is preferable that the temperature is set in a range of equal to or higher than 40° C. and lower than 100° C.

Further, between the step of splaying mist of hot water and the step of baking, a step of splaying air having a temperature equal to or higher than 40° C. and equal to or lower than 150° C. to the work may be provided.

In this step, the residual electrodeposition paint which is flowed out by spraying the hot water mist, and air having a temperature equal to or higher than 40° C. and equal to or lower than 150° C. is sprayed to this, thereby dispersing, drying and removing the flowed out electrodeposition paint. If the temperature is less than 40° C., the drying effect is insufficient, and if the temperature is equal to or higher than 150° C., the electrodeposition paint is boiled to generate a rough surface and therefore, it is preferable that the temperature is set in a range of equal to or higher than 40° C. and lower than 150° C.

Furthermore, between the step of splaying mist of hot water and the step of baking, a step of heating the work at a temperature equal to or higher than 40° C. and lower than 100° C., and a step of splaying air having a temperature equal to or higher than 40° C. and equal to or lower than 150° C. to the work may be provided.

According to this method, by heating the work at a temperature equal to or higher than 40° C. and lower than 100° C., and splaying air having a temperature equal to or higher than 40° C. and equal to or lower than 150° C., efficiency of dispersion and efficiency of drying of the flowed out electrodeposition paint is further enhanced.

In the step of splaying mist of hot water having a temperature equal to or higher than 40° C. and lower than 100° C. to the work, if water having a temperature equal to or higher than 20° C. and lower than 100° C. is splayed to the work at least once, it is possible to appropriately wash out the electrodeposition paint flowing out from the joint surface of the steel plates.

According to another aspect of the present invention, there is provided an electrodeposition method, comprising the steps of:

dipping a work into electrodeposition paint;

splaying vapor to the work; and baking the work.

According to this method, the electrodeposition paint entered the joint surfaces of the steel plates is heated by the sprayed vapor and the viscosity is lowered, so that the electrodeposition paint flows out. Further, by spraying the vapor to the work, dropwise condensation is adhered on the surface of the work, and this dropwise condensation has a function to pull out the flowed out electrodeposition paint so that the flowing out of the coating for deposition is facilitated.

Further, between the step of splaying vapor and the step of baking, a step of heating the work at a temperature equal to or higher than 40° C. and lower than 100° C. may be provided.

In this step, the flowed out residual electrodeposition paint is heated at a temperature equal to or higher than 40° C. and lower than 100° C. by spraying the vapor, thereby drying and removing the flowed out electrodeposition paint. If the temperature is less than 40° C., the drying effect is insufficient, and if the temperature is equal to or higher than 100° C., the flowed out electrodeposition paint is boiled to generate a rough surface and therefore, it is preferable that the temperature is set in a range of equal to or higher than 40° C. and lower than 100° C.

Furthermore, between the step of splaying vapor and the step of baking, a step of splaying air having a temperature equal to or higher than 40° C. and equal to or lower than 150° C. to the work may be provided.

In this step, the residual electrodeposition paint which is flowed out by spraying the vapor, and air having a temperature equal to or higher than 40° C. and equal to or lower than 150° C. is sprayed to this, thereby dispersing, drying and removing the flowed out electrodeposition paint. If the temperature is less than 40° C., the drying effect is insufficient, and if the temperature is equal to or higher than 150° C., the electrodeposition paint is boiled to generate a rough surface and therefore, it is preferable that the temperature is set in a range of equal to or higher than 40° C. and lower than 150° C.

Also, between the step of splaying vapor and the step of baking, a step of heating the work at a temperature equal to or higher than 40° C. and lower than 100° C., and a step of splaying air having a temperature equal to or higher than 40° C. and equal to or lower than 150° C. to the work.

By heating the work at a temperature equal to or higher than 40° C. and lower than 100° C., and splaying air having a temperature equal to or higher than 40° C. and equal to or lower than 150° C., efficiency of dispersion and efficiency of drying of the flowed out electrodeposition paint is further enhanced.

In the step of vapor to the work, if water having a temperature equal to or higher than 20° C. and lower than 100° C. may be splayed at least once, it is possible to appropriately wash out the electrodeposition paint flowing out from the joint surface of the steel plates.

According to another aspect of the present invention, there is provided an electrodeposition method, comprising the steps of:

dipping a work into electrodeposition paint;

heating the work at a temperature equal to or higher than 40° C. and lower than 100° C., and splaying, at least once, water having a temperature equal to or higher than 40° C. and lower than 100° C. to the work;

and baking the work.

According to this method, after the work is dipped into the electrodeposition paint, it is preheated at the temperature equal to or higher than 40° C. and lower than 100° C. Therefore, the electrodeposition paint is flowed out from the joint surface of the steel plates. At that time, since water having a temperature equal to or higher than 40° C. and lower than 100° C. is sprayed at least once, it is possible to appropriately wash out the electrodeposition paint flowing out from the joint surface of the steel plates. In this case, since the temperature of water to be sprayed is equal to or higher than 40° C., it is possible to facilitate the viscosity lowering effect by heating. If the temperature of water to be sprayed is equal to or higher than 100° C., it is not preferable because a rough surface is generated on the electrocoating.

A surface active agent may be included in the water. Since the work is preheated, if the water is used as it is, a spot may be generated on the work in some cases, but if the surface active agent is added, it is possible to prevent the spot from being generated on the work.

Poly oxyethylene nonyl phenyl ether is preferably used as the surface active agent. It is preferable that the concentration of the poly oxyethylene nonyl phenyl ether is in a range of 0.005% to 0.5%. If the content is lower than 0.005%, the effect of the surface active agent can not be expected, and if the content exceeds 0.5%, bubble is generated at the time of spray, which is not preferable. Further, if the content exceeds 0.5%, the spot preventing effect is saturated, and a rate of effect with respect to the material cost is lowered.

According to another aspect of the present invention, there is provided an electrodeposition method, comprising the steps of: dipping a work into electrodeposition paint; heating the work at a temperature equal to or higher than 40° C. and lower than 100° C., and splaying, at twice, water having a temperature equal to or higher than 20° C. and lower than 100° C. to the work; and baking the work.

According to this method, after the work is dipped into the electrodeposition paint, it is preheated at the temperature equal to or higher than 40° C. and lower than 100° C. Therefore, the electrodeposition paint is flowed out from the joint surface of the steel plates. At that time, since water having a temperature equal to or higher than 20° C. and lower than 100° C. is sprayed at least twice, it is possible to appropriately wash out the electrodeposition paint flowing out from the joint surface of the steel plates. In this case, if the temperature of water to be sprayed is lower than 20° C., the viscosity reducing effect due to the heating is prevented, which is not preferable. If the temperature of water to be sprayed is equal to or higher than 100° C., it is not preferable because a rough surface is generated on the electrocoating.

A surface active agent may be included in the water. Since the work is preheated, if the water is used as it is, a spot may be generated on the work in some cases, but if the surface active agent is added, it is possible to prevent the spot from being generated on the work.

The electrodeposition method of the present invention is not limited to the automobile body, and may be applied to automobile parts. The electrodeposition paint is not limited to cation, and may be anion. It is possible to provide one or more setting steps or one or more washing steps between the electrodeposition dipping step and the baking step.

When the work is heated (preheated) in a range of temperature equal to or higher than 40° C. and lower than 100° C., the automobile body may be heated locally or entirely.

The above and other objects, features and advantages of the invention will become apparent from the following description of a preferred embodiment taken in conjunction with the accompanying drawings.

BRIEF DESCRIPTION OF THE DRAWINGS

FIG. 17 is a view showing results of the examples 1 to 5 and comparative examples 1 to 3;

FIG. 18 is a view showing results of the examples 6 to 10 and comparative examples 4 to 7; and FIG. 19 is a view showing results of the examples 11 to 26 and comparative examples 8 and 9.

DETAILED DESCRIPTION OF THE PREFERRED EMBODIMENT

Embodiments of the present invention will be explained based on the drawings below.

EXAMPLE 1

As an evaluation sample, a white body of an actual automobile (Nissan Motor Co., Ltd., R11 type Presea (trademark)) was used, and the number of samples was twenty. Clearances between the joint surfaces of steel plates of lower portions of the actual automobiles were measured, and the average width of the clearances was 200 $\mu$m.

Figure 1A:
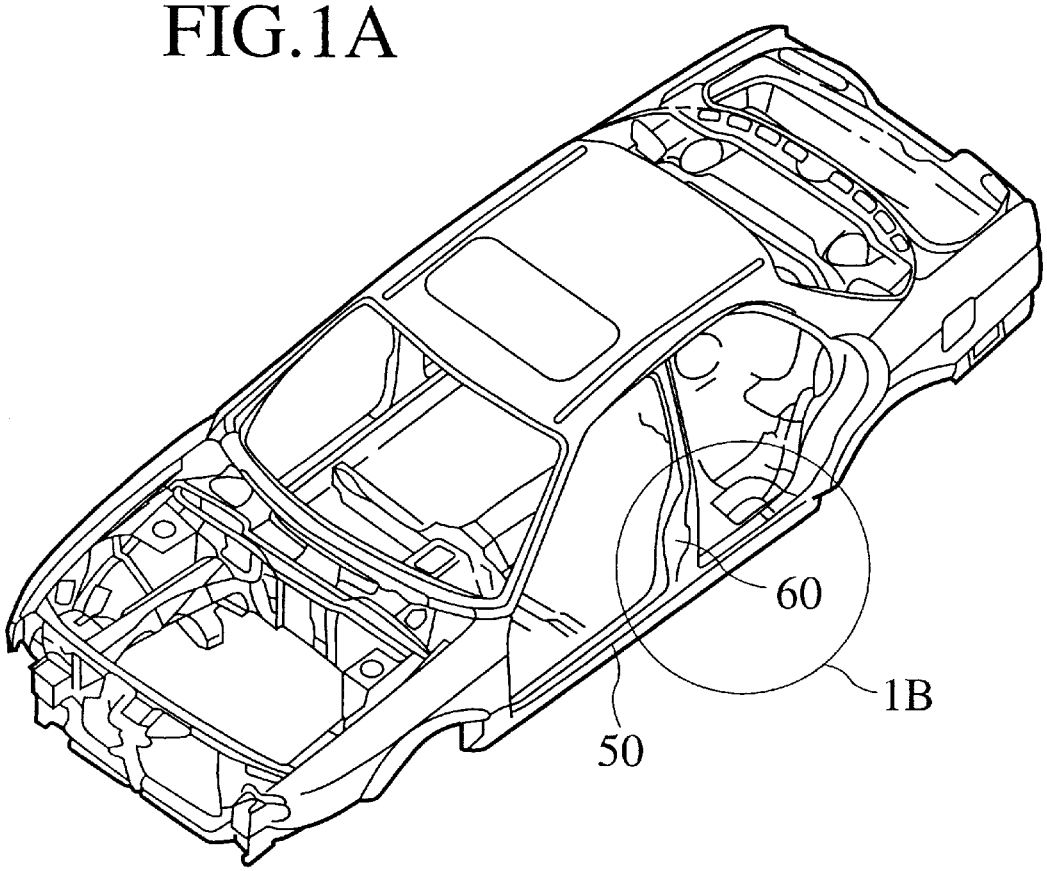
FIG. 1A is a perspective view showing an automobile body as a work.
Figure 1B:
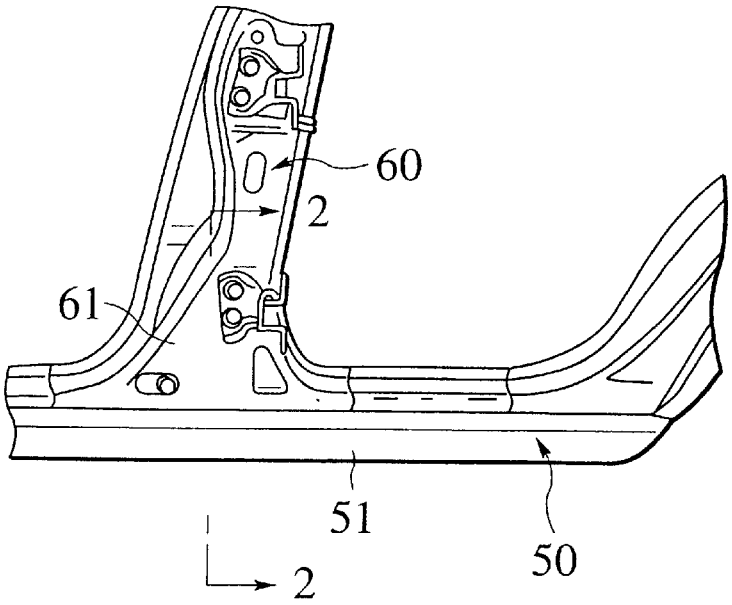
FIG. 1B is an enlarged view of a portion 1B in FIG. 1A.
Figure 2:
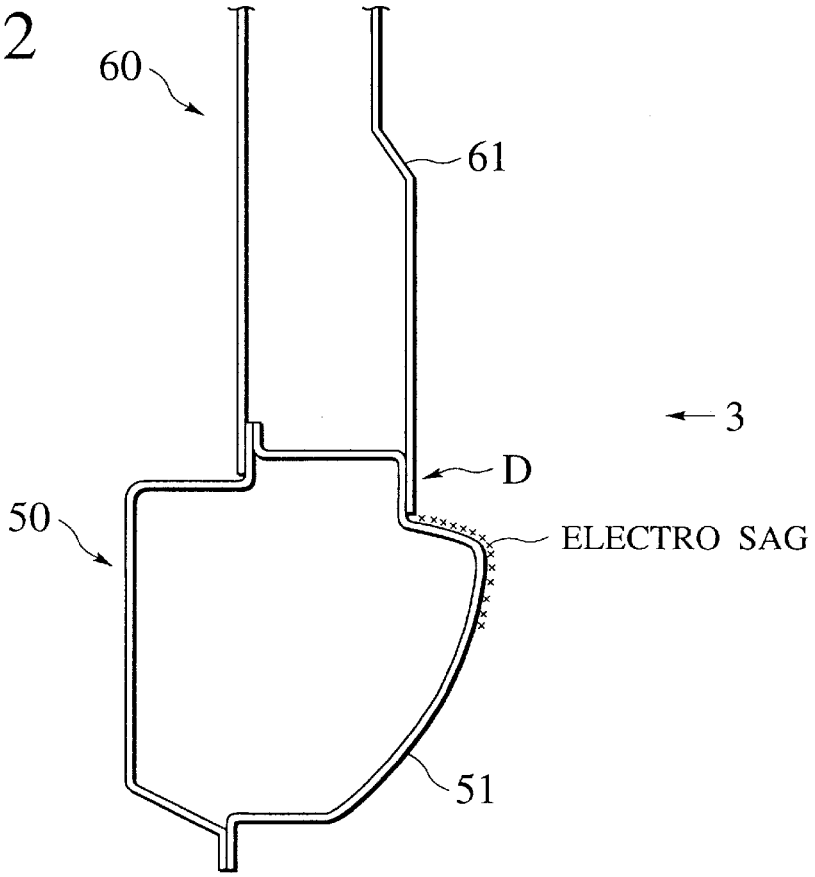
FIG. 2 is a sectional view taken along the line 2—2 in FIG. 1B.
Figure 3:
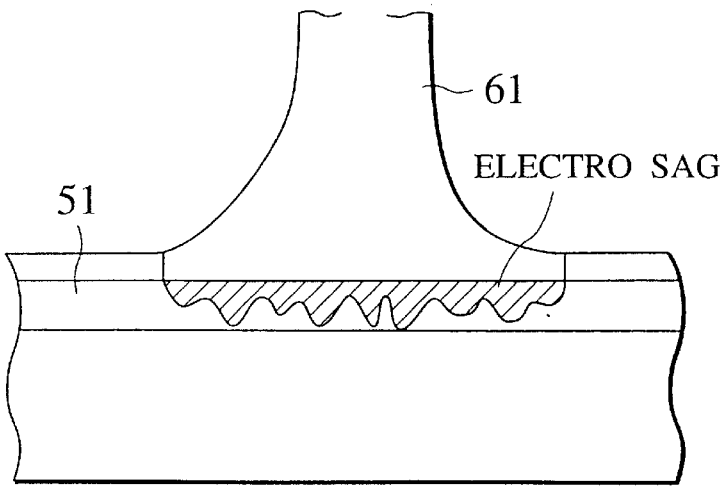
FIG. 3 is a view taken along the arrow 3 in FIG. 2.
Figure 4:
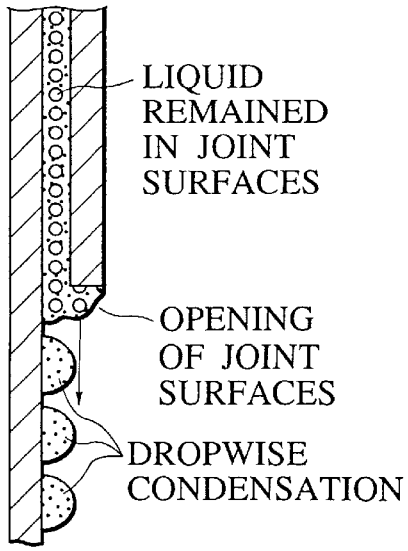
FIG. 4 is a view showing electrodeposition paint remained on a joint surface of steel plates.
Figure 5:
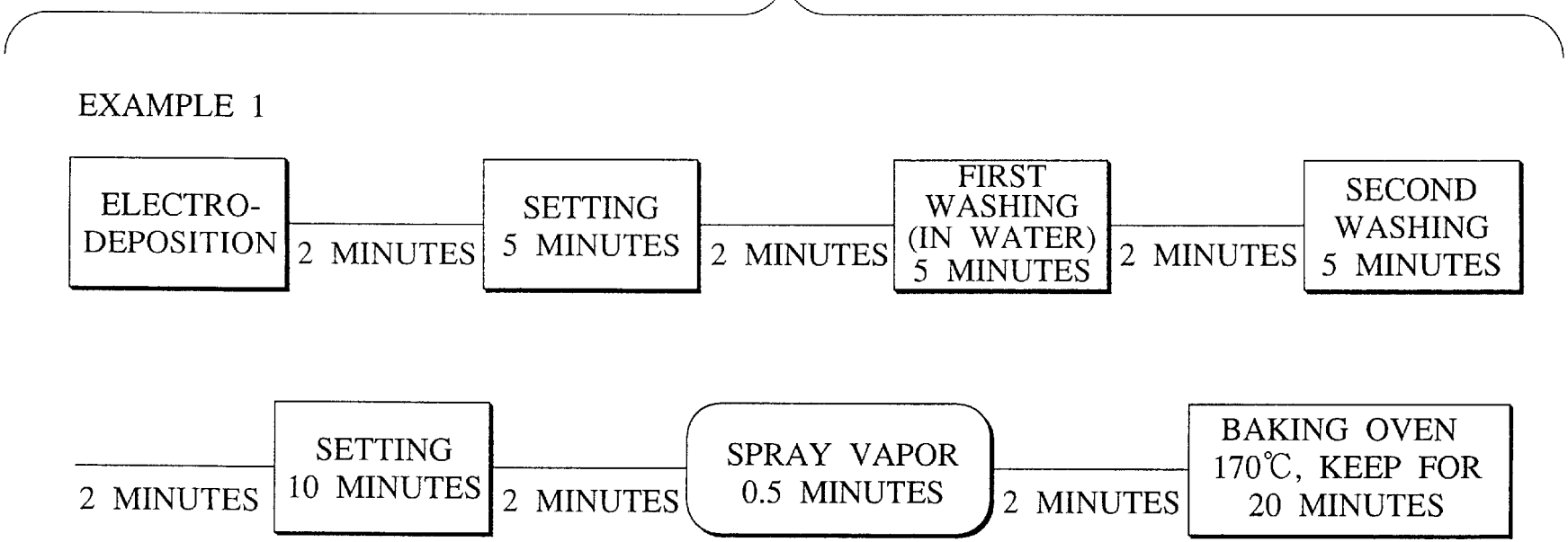
FIG. 5 is a block diagram of steps showing an example 1 of an electrodeposition method of the present invention.

As shown in FIG. 5, after the white body first was entirely dipped into a dipping tank, a setting was carried out for 5 minutes and then, a first washing in water for 5 minutes and a second washing in water for 5 minutes were carried out. The resultant body was subjected to a setting for 10 minutes and then, vapor was sprayed for 30 seconds through a nozzle using a vapor generating apparatus to the joint surfaces of steep plates at the lower portion of the center pillar shown in FIGS. 1A, 1B and 2. Lastly, the white body was baked under the condition of 170° C.×20 minutes For evaluation, an area where electro sag was generated on the actual automobile which has been baked as shown in FIG. 3 was measured, and was calculated at a % ratio taking the electro sag area of the comparative example as 100. As to the rough surface, it was visually evaluated, and the degree of the rough surface is classified into three degrees, i.e., small, medium and great.

EXAMPLE 2

Figure 6:
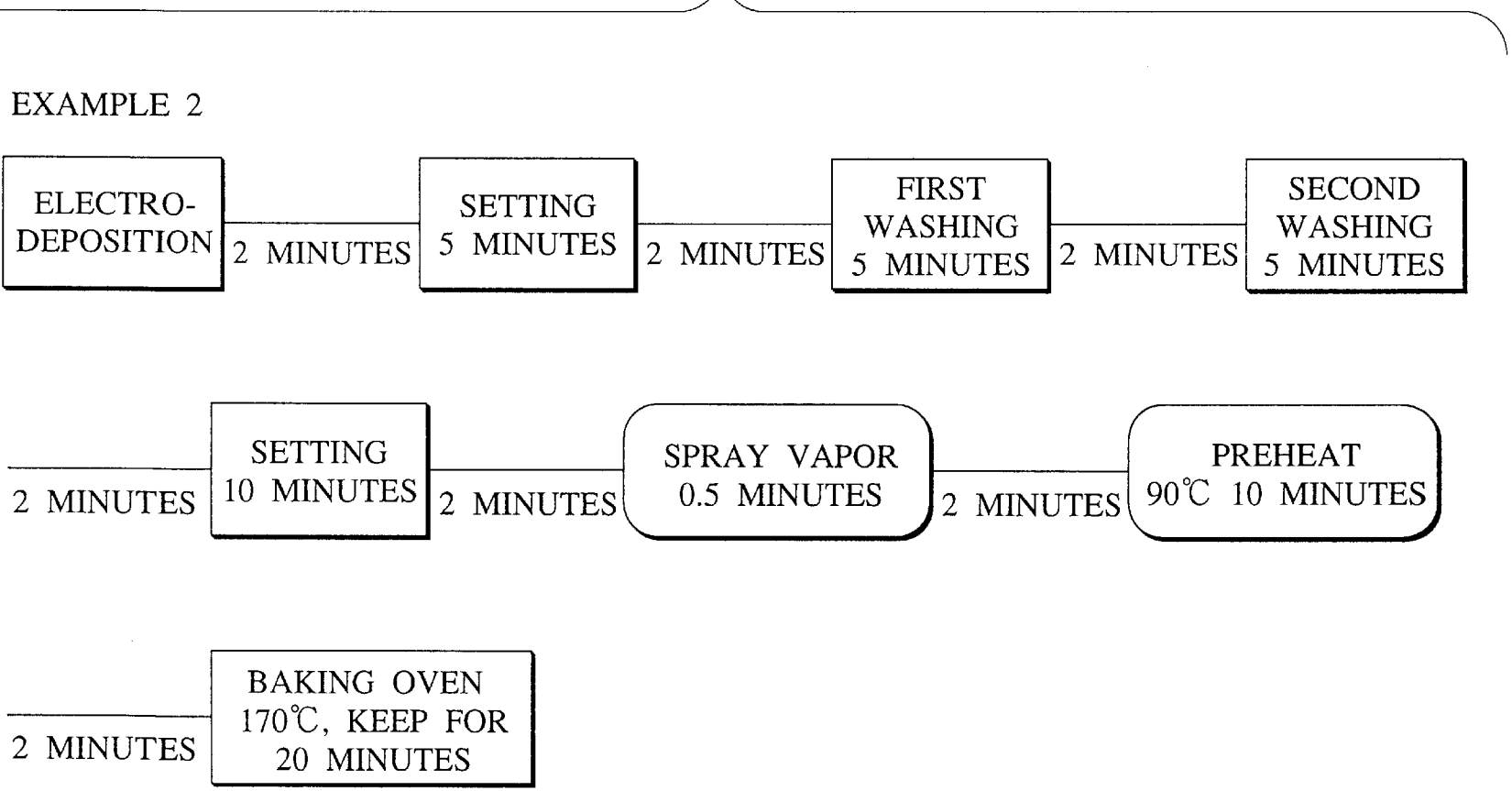
FIG. 6 is a block diagram of steps showing an example 2 of the electrodeposition method.

As shown in FIG. 6, after the vapor spraying step, a heating step (preheating step) of 90° C.×10 minutes was provided, and the white body was coated under the same condition as the example 1 except that the joint surfaces of steep plates at the lower portion of the center pillar was heated. Further, the electro sag area and the rough surface were evaluated in the same manner as that of the example 1. The results are shown in FIG. 17.

EXAMPLE 3

Figure 7:
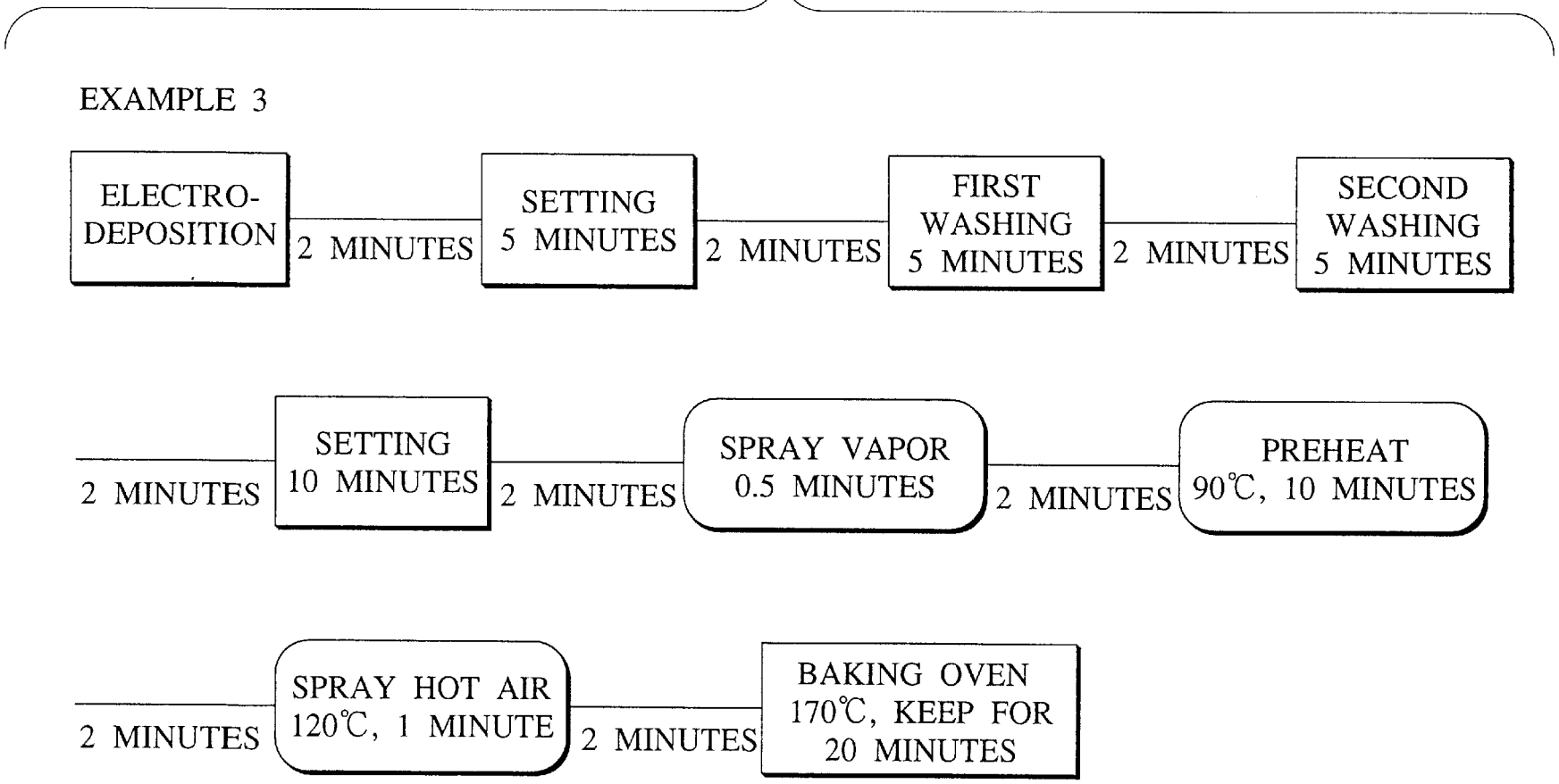
FIG. 7 is a block diagram of steps showing an example 3 of the electrodeposition method.

As shown in FIG. 7, a hot air spraying step of 120° C.×1 minute is provided after the preheating step, and the white body was coated under the same condition as the example 2 except that hot air is sprayed to the joint surfaces of steep plates at the lower portion of the center pillar. Further, the electro sag area and the rough surface were evaluated in the same manner as that of the example 1. The results are in shown in FIG. 17.

EXAMPLE 4

Figure 8:
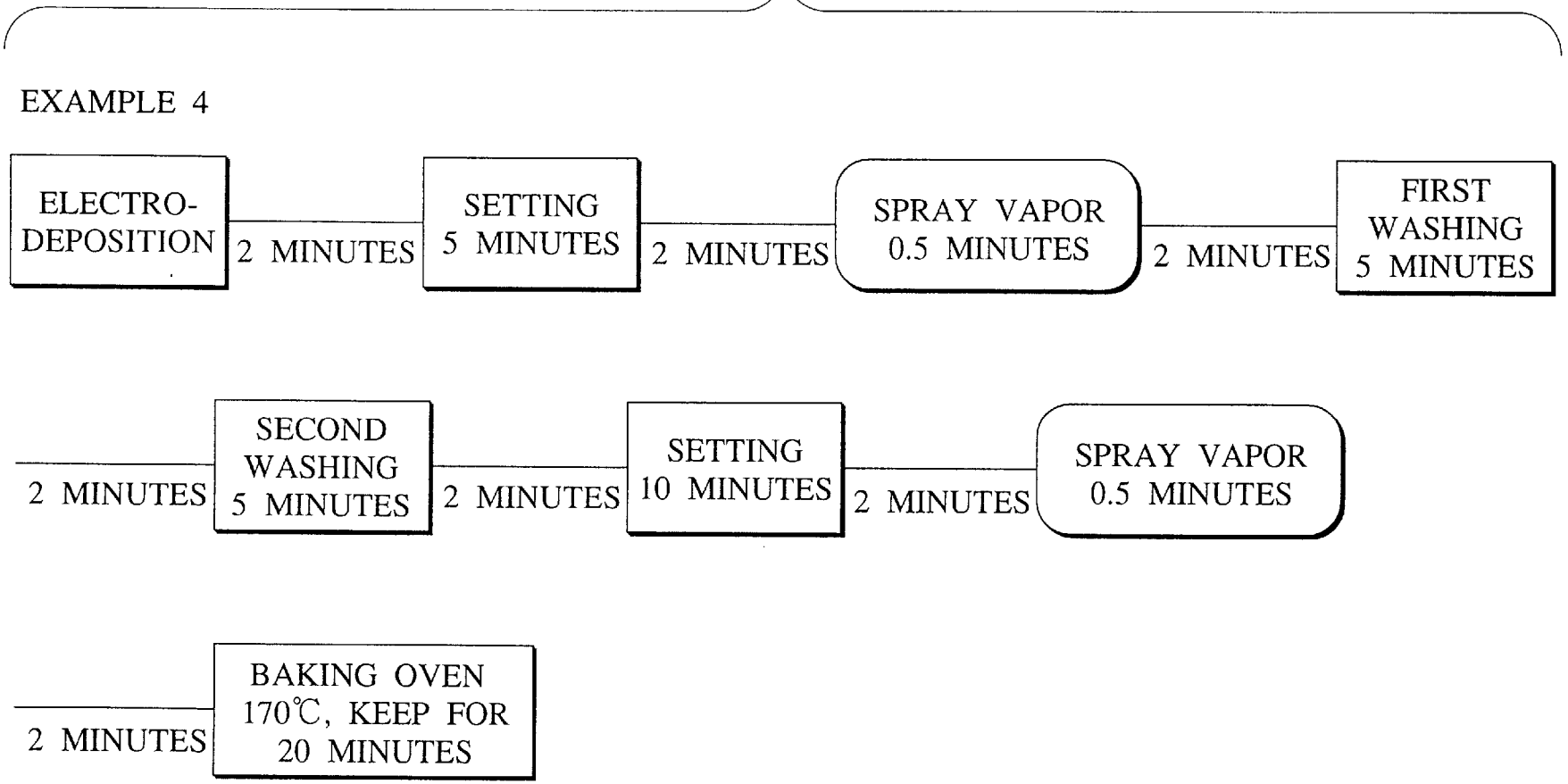
FIG. 8 is a block diagram of steps showing an example 4 of the electrodeposition method.

As shown in FIG. 8, the white body was coated under the same condition as the example 1 except that a vapor spraying step of 80° C.×30 seconds is provided between the first setting step and the first washing step. Further, the electro sag area and the rough surface were evaluated in the same manner as that of the example 1. The results are shown in FIG. 17. In the present example, the residual electrodeposition paint is flowed out from the joint surfaces of steel plates immediately after the white body is pulled out from the dipping tank and then, the residual electrodeposition paint is washed out by the subsequent step so that the electro sag is prevented from being generated more reliably.

EXAMPLE 5

Figure 9:
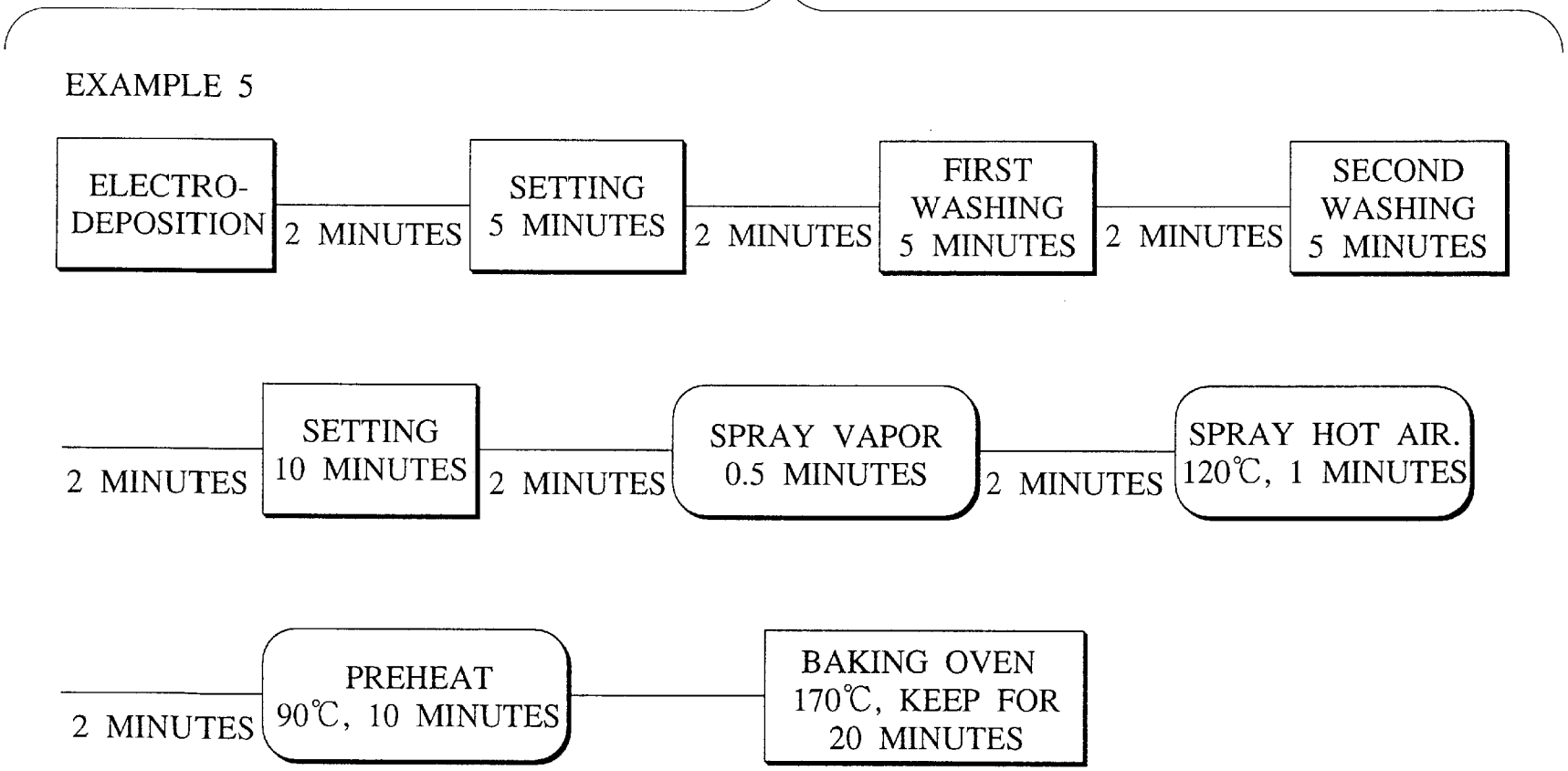
FIG. 9 is a block diagram of steps showing an example 5 of the electrodeposition method.

As shown in FIG. 9, the white body was coated under the same condition as the example 3 except that the hot air spraying step was replaced by a preheating step. Further, the electro sag area and the rough surface were evaluated in the same manner as that of the example 1. The results are shown in FIG. 17.

COMPARATIVE EXAMPLE 1

Figure 10:
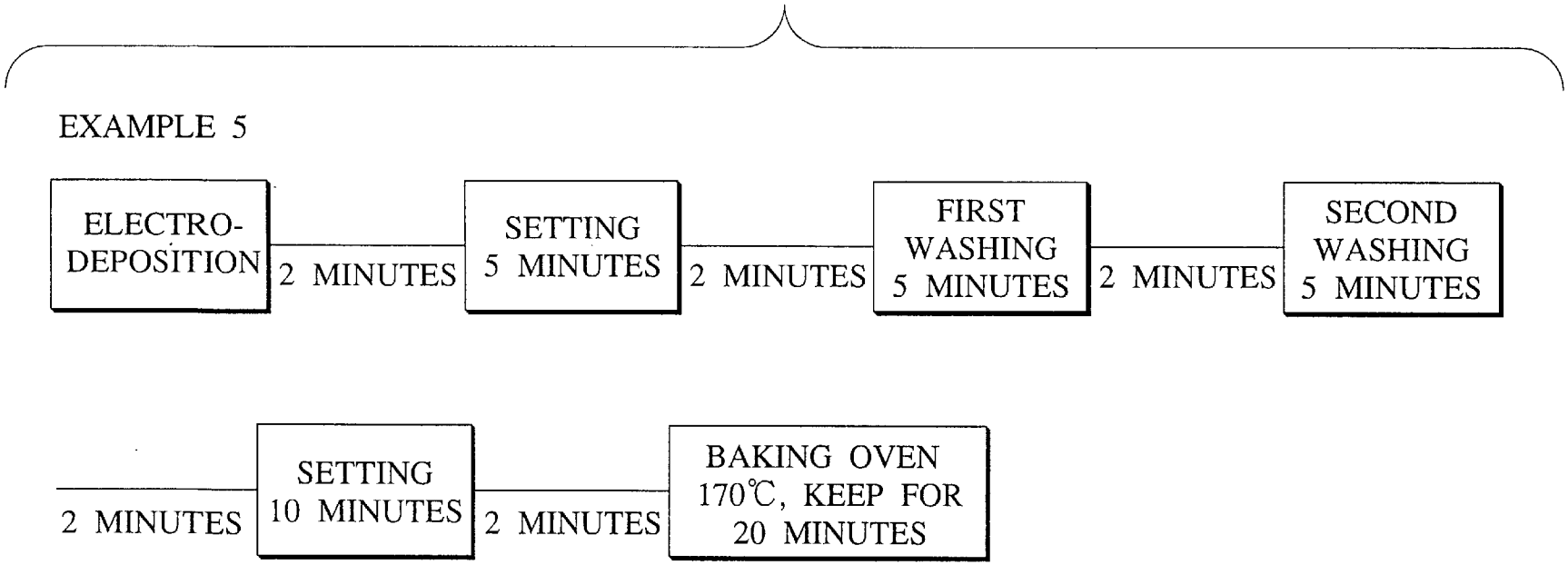
FIG. 10 is a block diagram of steps showing a comparative example of an electrodeposition method.

As shown in FIG. 10, the white body was coated under the same condition as the example 1 except that vapor spraying step was omitted. Further, the electro sag area and the rough surface were evaluated in the same manner as that of the example 1. The results are shown in FIG. 17.

COMPARATIVE EXAMPLE 2

The white body was coated under the same condition as the example 2 except that the condition of the preheating step shown in FIG. 6 was changed to 110° C.×10 minutes. Further, the electro sag area and the rough surface were evaluated in the same manner as that of the example 1. The results are shown in FIG. 17.

COMPARATIVE EXAMPLE 3

The white body was coated under the same condition as the example 3 except that the condition of the hot air spraying step shown in FIG. 7 was changed to 160° C.×1 minute. Further, the electro sag area and the rough surface were evaluated in the same manner as that of the example 1. The results are shown in FIG. 17.

From the results of the examples 1 to 5 and the comparative examples 1 to 3, the following matters can be understood. First, from the result of the example 1 and the comparative example 1, it can be understood that the electro sag area is reduced by 25% by providing the vapor spraying step, the number of adjustment steps can be reduced.

From the result of the examples 1 to 3, it can be understood that the electro sag area becomes smaller, and the surface condition becomes better in order of (example 2) in which the preheating step is added to the vapor spraying step, and (example 3) in which the hot air spraying step is further added.

From the result of the examples 1 and 4, it can be understood that if the vapor spraying step is added immediately after the white body is pulled out from the dipping tank, the electro sag area is suddenly reduced, and the surface condition is enhanced. From the result of the examples 3 and 5, it can be understood that if the preheating step and the hot air spraying step are added to the vapor spraying step, the electro sag area is slightly reduced when the hot air spraying step is carried out as a pretreatment step.

From the result of the comparative examples 2 and 3, it can be understood that if the preheating temperature and the hot air temperature are excessively high, the degree of rough surface is worsened.

The present invention will be explained based on other examples.

EXAMPLE 6

Figure 11:
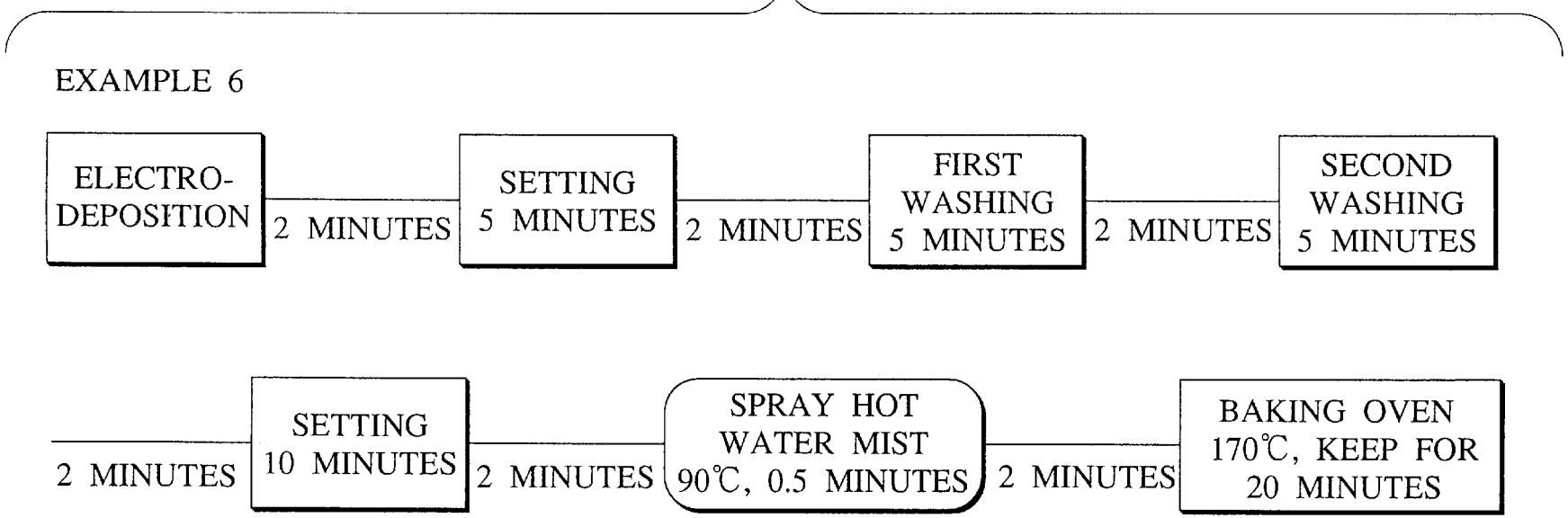
FIG. 11 is a block diagram of steps showing an example 6 of the electrodeposition method.

Using the same actual automobile as in the example 1, hot water mist was sprayed to the joint surfaces of steel plates at the lower portion of the center pillar by an air gun instead of the vapor spraying step in the example 1 as shown in FIG. 11. Particle size of the hot water mist was adjusted to be ϕ 0.05 mm (50 m) or less.

The electro sag and degree of rough surface were evaluated as in the example 1, and it was evaluated whether there exists a track of electro sag of 30 mm or more for which the number of adjustment steps becomes maximum. The results are shown in FIG. 18.

EXAMPLE 7

Figure 12:
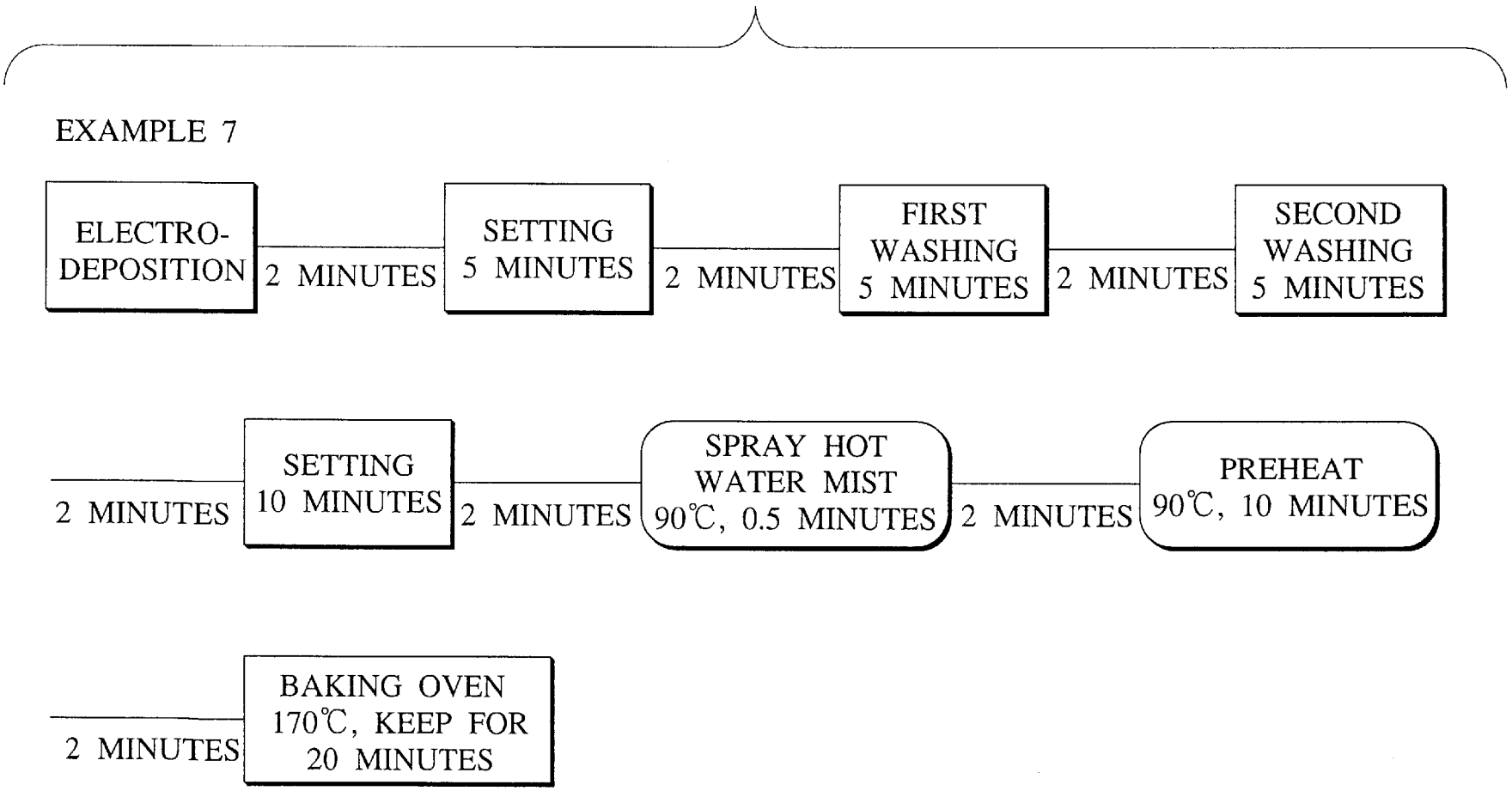
FIG. 12 is a block diagram of steps showing an example 7 of the electrodeposition method.

As shown in FIG. 12, the white body was coated under the same condition as the example 6 except that a heating step (preheating step) of 90° C.×10 minutes was provided after the hot water mist spraying step, and the joint surfaces of steel plates at the lower portion of the center pillar was heated. Further, the electro sag area and the rough surface were evaluated in the same manner as that of the example 6. The results are shown in FIG. 18.

EXAMPLE 8

Figure 13:
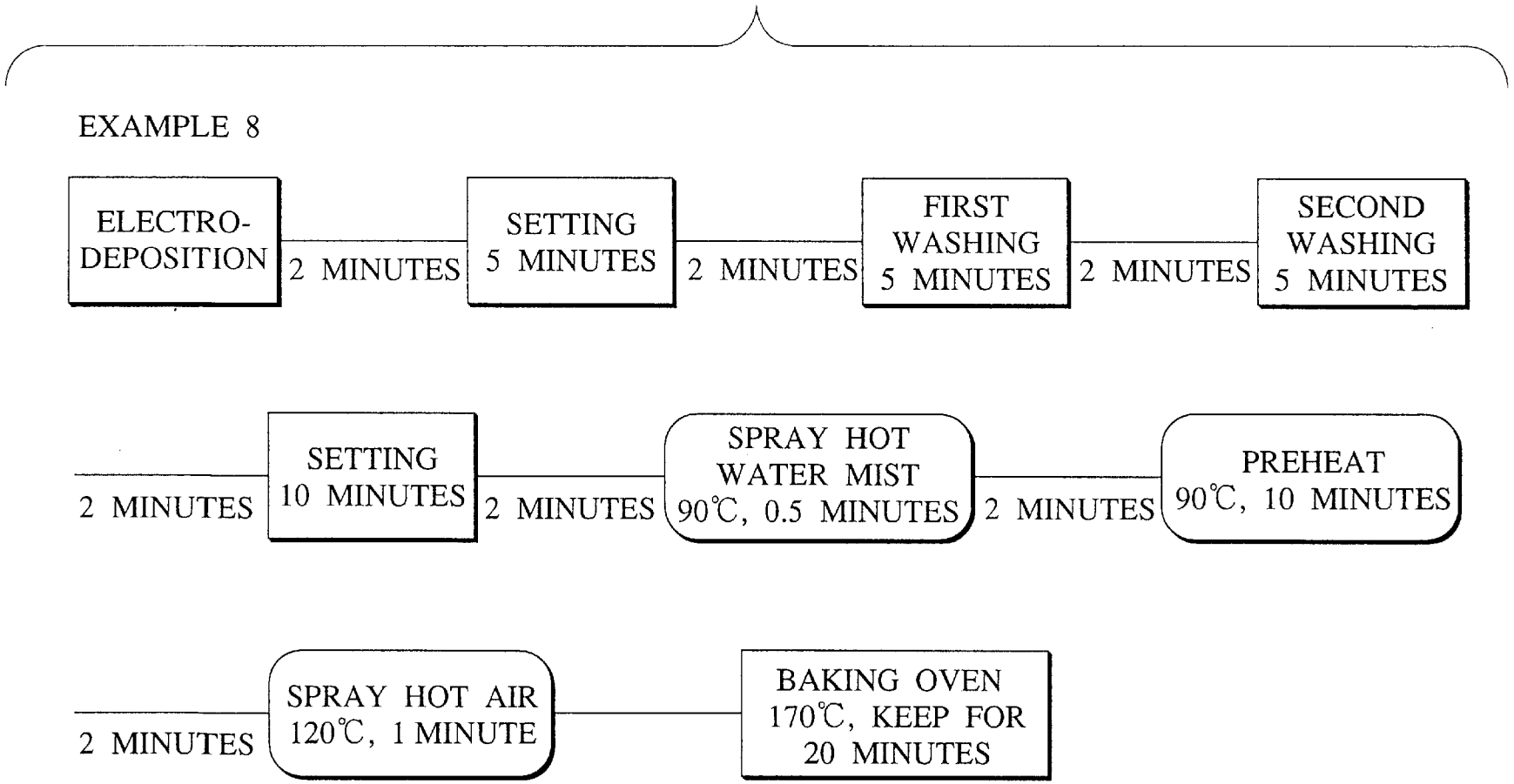
FIG. 13 is a block diagram of steps showing an example 8 of the electrodeposition method.

As shown in FIG. 13, the white body was coated under the same condition as the example 7 except that a hot air spraying step of 120° C.×1 minute was provided after the preheating step, and the joint surfaces of steel plates at the lower portion of the center pillar was heated. Further, the electro sag area and the rough surface were evaluated in the same manner as that of the example 6. The results are shown in FIG. 18.

EXAMPLE 9

Figure 14:
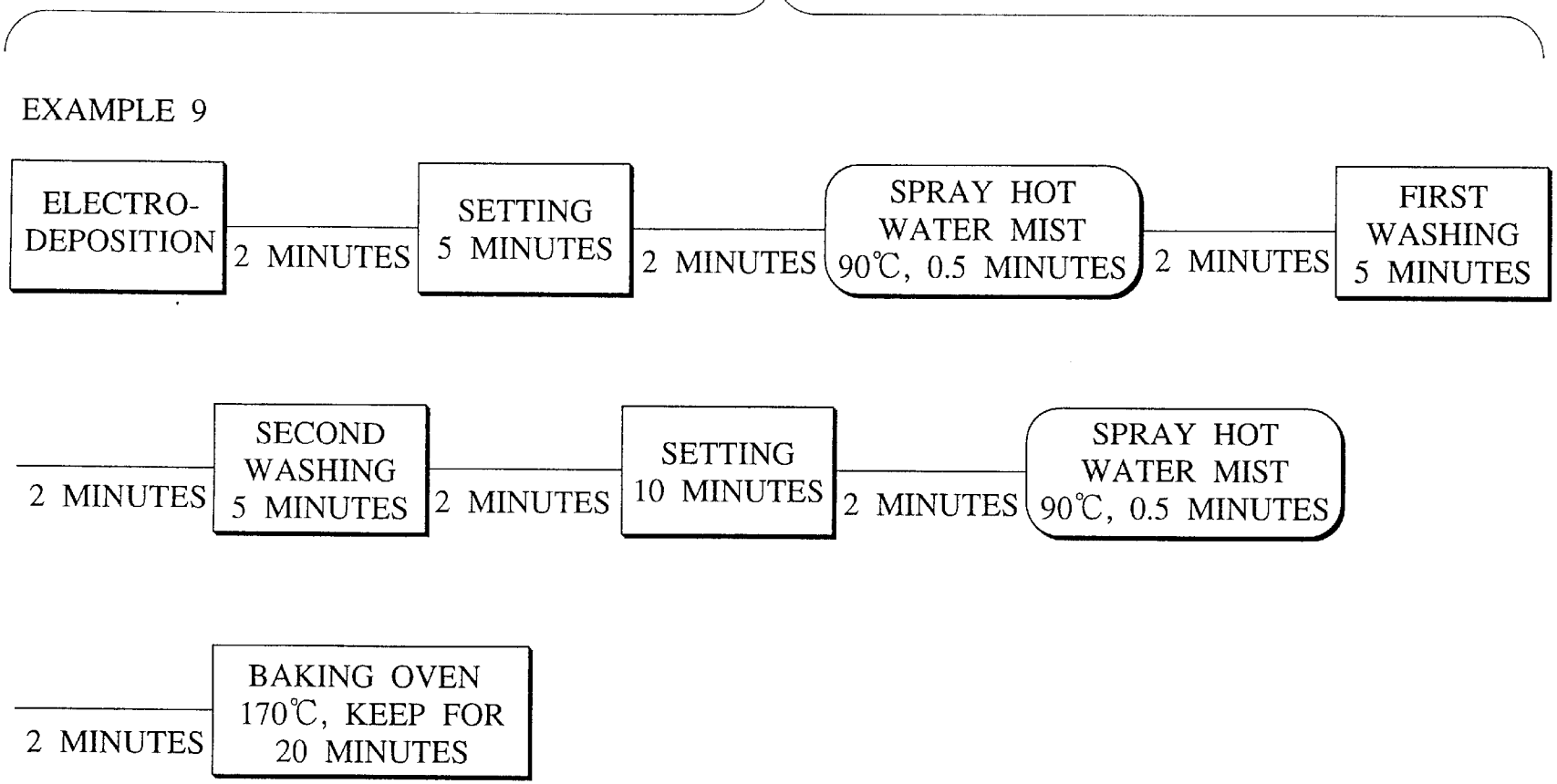
FIG. 14 is a block diagram of steps showing an example 9 of the electrodeposition method.

As shown in FIG. 14, the white body was coated under the same condition as the example 6 except that a vapor spraying step of 90° C.×30 seconds is provided between the first setting step and the first washing step. Further, the electro sag area and the rough surface were evaluated in the same manner as that of the example 6. Table 2 shows the results. In the present example, the residual electrodeposition paint is flowed out from the joint surfaces of steel plates immediately after the white body is pulled out from the dipping tank and then, the residual electrodeposition paint is washed out by the subsequent step so that the electro sag is prevented from being generated more reliably.

EXAMPLE 10

Figure 15:
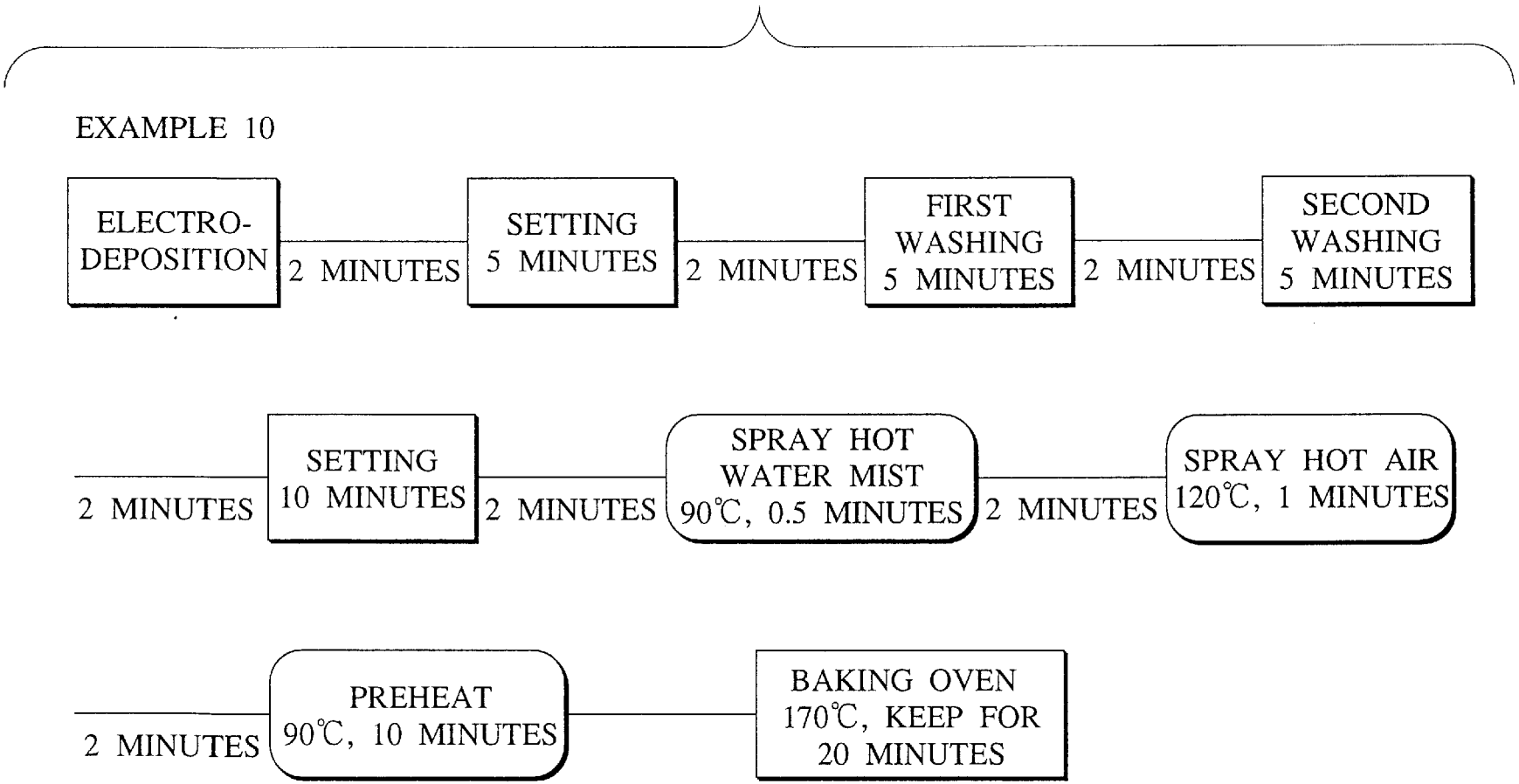
FIG. 15 is a block diagram of steps showing an example 10 of the electrodeposition method.

As shown in FIG. 15, the white body was coated under the same condition as the example 8 except that the hot air spraying step was replaced by a preheating step. Further, the electro sag area and the rough surface were evaluated in the same manner as that of the example 6. The results are shown in FIG. 18.

COMPARATIVE EXAMPLE 4

As shown in FIG. 10, the white body was coated under the same condition as the example 6 except that the hot water mist spraying step was omitted. Further, the electro sag area and the rough surface were evaluated in the same manner as that of the example 6. The results are shown in FIG. 18.

COMPARATIVE EXAMPLE 5

The white body was coated under the same condition as the example 6 except that the condition of the hot water mist step shown in FIG. 11 was changed to 30° C. Further, the electro sag area and the rough surface were evaluated in the same manner as that of the example 6. The results are shown in FIG. 18.

COMPARATIVE EXAMPLE 6

The white body was coated under the same condition as the example 7 except that the condition of the preheating step shown in FIG. 12 was changed to 100° C.×10 minutes. Further, the electro sag area and the rough surface were evaluated in the same manner as that of the example 6. The results are shown in FIG. 18.

COMPARATIVE EXAMPLE 7

The white body was coated under the same condition as the example 8 except that the condition of the hot air spraying step shown in FIG. 13 was changed to 160° C.×1 minute. Further, the electro sag area and the rough surface were evaluated in the same manner as that of the example 6. The results are shown in FIG. 19.

From the results of the examples 6 to 10 and the comparative examples 4 to 7, the following matters can be understood. First, from the result of the example 6 and the comparative example 4, it can be understood that the electro sag area is reduced by 20% by providing the hot water mist spraying step, and the long electro sag can be prevented and therefor, the number of adjustment steps can remarkably be reduced.

From the result of the examples 6 to 8, it can be understood that the electro sag area becomes smaller, and the surface condition becomes better in order of (example 7) in which the preheating step is added to the hot water mist spraying step, and (example 8) in which the hot air spraying step is further added.

From the result of the examples 6 and 9, it can be understood that if the hot water mist spraying step is added immediately after the white body is pulled out from the dipping tank, the electro sag area is suddenly reduced. From the result of the examples 8 and 10, it can be understood that if the preheating step and the hot air spraying step are added to the hot water mist spraying step, the electro sag area is slightly reduced when the hot air spraying step is carried out as a pretreatment step.

From the result of the comparative example 5, it can be understood that if the hot water mist temperature is excessively low, effect against the electro sag is reduced. From the result of the comparative examples 6 and 7, it can be understood that if the temperature of preheating and the temperature of the hot air are excessively high, the degree of rough surface is worsened.

The present invention will be explained based on other examples.

EXAMPLE 11

Figure 16:
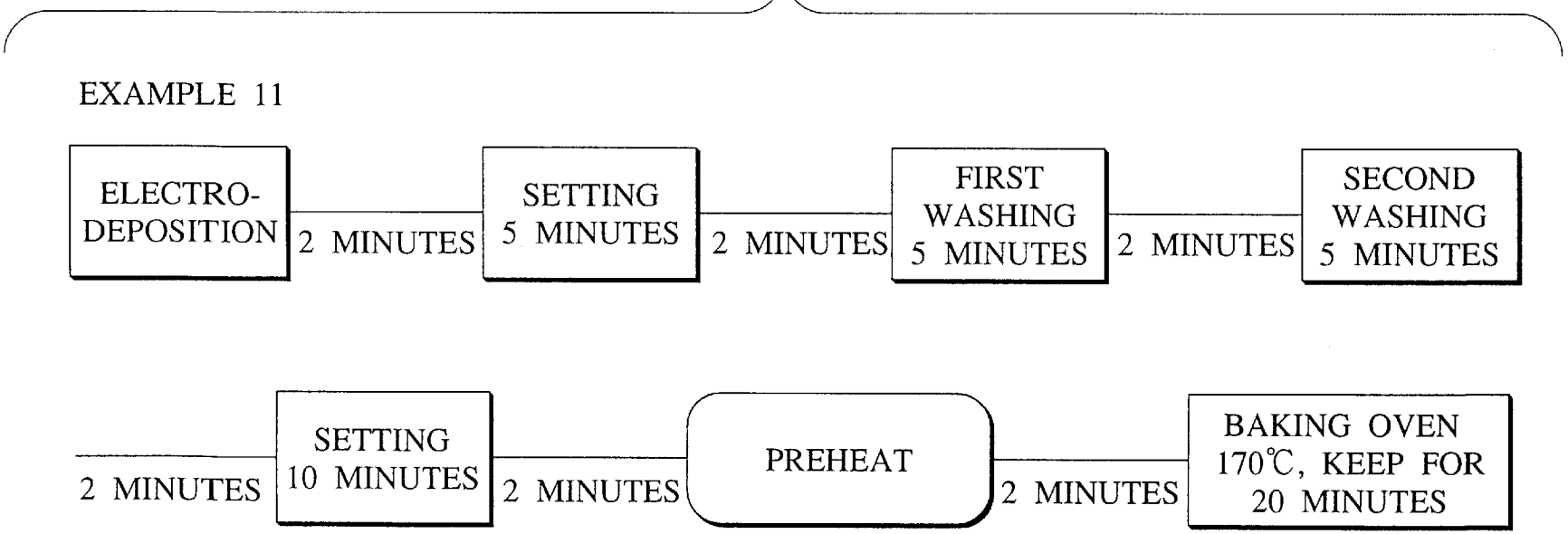
FIG. 16 is a block diagram of steps showing examples 11 to 26 the electrodeposition method.

Using the same actual automobile as in the example 1, A heating step (preheating step) of 90° C.×10 minutes was provided instead of the vapor spraying step in the example 1, and the joint surfaces of steel plates at the lower portion of the center pillar was heated as shown in FIG. 16. In this step, water of 20° C. was sprayed to the lower portion of the center pillar for 30 seconds.

The electro sag area and the rough surface were evaluated in the same manner as that of the example 1. The results are shown in FIG. 19.

EXAMPLE 12

The white body was coated under the same condition as the example 11 except that the number of water spray was changed to twice. Further, the electro sag area and the rough surface were evaluated in the same manner as that of the example 11. The results are shown in FIG. 19.

EXAMPLE 13

The white body was coated under the same condition as the example 11 except that the number of water spray was changed to five times. Further, the electro sag area and the rough surface were evaluated in the same manner as that of the example 11. The results are shown in FIG. 19.

EXAMPLE 14

The white body was coated under the same condition as the example 11 except that the number of water spray was changed to ten times. Further, the electro sag area and the rough surface were evaluated in the same manner as that of the example 11. The results are shown in FIG. 19.

EXAMPLE 15

The white body was coated under the same condition as the example 11 except that the temperature of the water was changed to 40° C. Further, the electro sag area and the rough surface were evaluated in the same manner as that of the example 11. The results are shown in FIG. 19.

EXAMPLE 16

The white body was coated under the same condition as the example 12 except that the temperature of the water was changed to 40° C. Further, the electro sag area and the rough surface were evaluated in the same manner as that of the example 12. The results are shown in FIG. 19.

EXAMPLE 17

The white body was coated under the same condition as the example 13 except that the temperature of the water was changed to 40° C. Further, the electro sag area and the rough surface were evaluated in the same manner as that of the example 13. The results are shown in FIG. 19.

EXAMPLE 18

The white body was coated under the same condition as the example 14 except that the temperature of the water was changed to 40° C. Further, the electro sag area and the rough surface were evaluated in the same manner as that of the example 14. The results are shown in FIG. 19.

EXAMPLE 19

The white body was coated under the same condition as the example 11 except that the temperature of the water was changed to 80° C. Further, the electro sag area and the rough surface were evaluated in the same manner as that of the example 11. The results are shown in FIG. 19.

EXAMPLE 20

The white body was coated under the same condition as the example 12 except that the temperature of the water was changed to 80° C. Further, the electro sag area and the rough surface were evaluated in the same manner as that of the example 12. The results are shown in FIG. 19.

EXAMPLE 21

The white body was coated under the same condition as the example 13 except that the temperature of the water was changed to 80° C. Further, the electro sag area and the rough surface were evaluated in the same manner as that of the example 13. The results are shown in FIG. 19.

EXAMPLE 22

The white body was coated under the same condition as the example 14 except that the temperature of the water was changed to 80° C. Further, the electro sag area and the rough surface were evaluated in the same manner as that of the example 14. The results are shown in FIG. 19.

EXAMPLE 23

The white body was coated under the same condition as the example 11 except that the temperature of the water was changed to 99° C. Further, the electro sag area and the rough surface were evaluated in the same manner as that of the example 11. The results are shown in FIG. 19.

EXAMPLE 24

The white body was coated under the same condition as the example 12 except that the temperature of the water was changed to 99° C. Further, the electro sag area and the rough surface were evaluated in the same manner as that of the example 12. The results are shown in FIG. 19.

EXAMPLE 25

The white body was coated under the same condition as the example 13 except that the temperature of the water was changed to 99° C. Further, the electro sag area and the rough surface were evaluated in the same manner as that of the example 13. The results are shown in FIG. 19.

EXAMPLE 26

The white body was coated under the same condition as the example 14 except that the temperature of the water was changed to 99° C. Further, the electro sag area and the rough surface were evaluated in the same manner as that of the example 14. The results are shown in FIG. 19.

COMPARATIVE EXAMPLE 8

The white body was coated under the same condition as the example 11 except that the temperature of the water was changed to 19° C. Further, the electro sag area and the rough surface were evaluated in the same manner as that of the example 11. The results are shown in FIG. 19.

COMPARATIVE EXAMPLE 9

The white body was coated under the same condition as the example 11 except that the temperature of the water was changed to 100° C. Further, the electro sag area and the rough surface were evaluated in the same manner as that of the example 11. The results are shown in FIG. 19.

From the results of the examples 11 to 26 and the comparative examples 8 and 9, the following matters can be understood. First, when water is sprayed in the preheating zone, if the temperature of the water to be sprayed is lower than 20° C., the electro sag area is large, which is not preferable. This is because that the viscosity of the electrodeposition paint is prevented from being lowered. On the contrary, if water of high temperature of 100° C. or higher, it is not preferable because the coated surface becomes rough.

As is obvious from the results of the example 14, 18 and 22, as the number of water spray is greater, the electro sag is remarkably reduced.

The embodiment has been described for facilitating an understanding of the present invention, and not for limiting the present invention. Therefore, each of the elements disclosed in the above-described embodiment includes all of the modifications and equivalence in design belonging to the technical field of the present invention.

What is claimed is:

1. An electrodeposition method, comprising the steps of:

dipping a work into electrodeposition paint;

spraying a mist of hot water having a temperature equal to or higher than 40° C. and lower than 100° C. onto the work;

spraying air having a temperature equal to or higher than 40° C. and equal to or lower than 150° C. to the work; and baking the work.

2. An electrodeposition method according to claim 1, further comprising, between the step of spraying mist of hot water and the step of baking, a step of heating the work at a temperature equal to or higher than 40° C. and lower than 100° C.

3. An electrodeposition method according to claim 1, wherein the step of spraying mist of hot water having a temperature equal to or higher than 40° C. and lower than 100° C. to the work includes a step of spraying water having a temperature equal to or higher than 20° C. and lower than 100° C. to the work at least once.

4. An electrodeposition method, comprising the steps of:

dipping a work into electrodeposition paint;

spraying vapor onto the work;

spraying air having a temperature equal to or higher than 40° C. and equal to or lower than 150° C. onto the work; and baking the work.

5. An electrodeposition method according to claim 4, further comprising, between the step of spraying vapor and the step of baking, a step of heating the work at a temperature equal to or higher than 40° C. and lower than 100° C.

6. An electrodeposition method according to claim 4, wherein the step of spraying vapor to the work includes a step of spraying water having a temperature equal to or higher than 20° C. and lower than 100° C. to the work at least once.

7. An electrodeposition method, comprising the steps of:

dipping a work into electrodeposition paint;

heating the work at a temperature equal to or higher than 40° C. and lower than 100° C., and spraying, at least once, water having a temperature equal to or high than 40° C. and lower than 100° C. to the work;

spraying air having a temperature equal to or higher than 40° C. and equal to or lower than 150° C. to the work; and baking the work.

8. An electrodeposition method according to claim 7, wherein the water comprises a surface active agent.

9. An electrodeposition method according to claim 8, wherein the surface active agent comprises poly oxyethylene nonyl phenyl ether.

10. An electrodeposition method according to claim 8, wherein the surface active agent comprises poly oxyethylene nonyl phenyl ether having concentration of 0.005% to 0.5%.

11. An electrodeposition method, comprising the steps of:

dipping a work into electrodeposition paint;

heating the work at a temperature equal to or higher than 40° C. and lower than 100° C., and spraying, at twice, water having a temperature equal to or higher than 40° C. and lower than 100° C. to the work;

spraying air having a temperature equal to or higher than 40° C. and equal to or lower than 150° C. to the work; and baking the work.

12. An electrodeposition method according to claim 11, wherein the water comprises a surface active agent.

13. An electrodeposition method according to claim 12, wherein the surface active agent comprises poly oxyethylene nonyl phenyl ether.

14. An electrodeposition method according to claim 12, wherein the surface active agent comprises poly oxyethylene nonyl phenyl ether having concentration of 0.005% to 0.5%.

* * * * *